US011486377B1

(12) United States Patent
Wu

(10) Patent No.: US 11,486,377 B1
(45) Date of Patent: Nov. 1, 2022

(54) QUICKLY ASSEMBLED AIR PUMP COMPRISING A CYLINDER WITH A RETAINING HOLD ADJACENT TO AN OPENING FOR A POSITION ROD WHEREIN A RETAINING PORTION OF AN UPPER COVER IS ENGAGED WITH THE RETAINING HOLE AND A CONICAL LATERAL FACE OF A PISTON IS SELECTIVELY ABUTTED AGAINST AN EXTENSION PORTION OF THE UPPER COVER

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 0 days.

(21) Appl. No.: 17/371,187

(22) Filed: Jul. 9, 2021

(51) Int. Cl.
*F04B 33/00* (2006.01)
*F04B 39/14* (2006.01)

(52) U.S. Cl.
CPC ..... *F04B 33/005* (2013.01); *F04B 39/14* (2013.01)

(58) Field of Classification Search
CPC .... F04B 33/005; F04B 25/02; F04B 39/0016; F04B 39/14; F04B 33/00; F04B 25/005; F04B 27/005; F04B 39/123; F04B 49/08
USPC ..... 417/523; 188/300; 267/64.12
See application file for complete search history.

(56) References Cited

U.S. PATENT DOCUMENTS 3,915,242 A * 10/1975 Bell ..... B25C 1/14 173/206
3,981,625 A * 9/1976 Wickenberg ..... G01L 17/00 417/63
4,166,612 A * 9/1979 Freitag ..... E05F 3/02 188/300
4,257,582 A * 3/1981 Wirges ..... A47C 3/30 188/300
4,871,149 A * 10/1989 Dony ..... A47B 9/10 267/64.12
5,051,073 A * 9/1991 Newbold ..... F04B 33/005 417/527
5,443,370 A * 8/1995 Wang ..... F04B 39/0016 417/547
5,676,529 A * 10/1997 Hermansen ..... F04B 33/005 417/259
5,997,256 A * 12/1999 Gunther ..... F04B 33/005 417/259

(Continued)

FOREIGN PATENT DOCUMENTS

TW I353417 B 12/2011

*Primary Examiner* — Devon C Kramer
*Assistant Examiner* — Benjamin Doyle
(74) *Attorney, Agent, or Firm* — Karin L. Williams; Alan D. Kamrath; Mayer & Williams PC

(57) ABSTRACT

An air pump includes a cylinder, a piston rod, and an upper cover. The cylinder forms an opening at a top end thereof and at least one retaining hole adjacent to the opening. The piston rod is configured to be movable within the cylinder and provided with a piston forming a conical lateral face at one end thereof. The upper cover has a top portion forming a hole for the piston rod to penetrate therethrough, at least one extension portion extended from the top portion, and at least one retaining portion extended from the extension portion. The least one extension portion has an abutting edge selectively abutted against the conical lateral face. The retaining portion is engaged with the retaining hole.

9 Claims, 6 Drawing Sheets

(56) References Cited

U.S. PATENT DOCUMENTS 6,017,201 A * 1/2000 Yang ..... F04B 25/005 417/454
6,027,316 A * 2/2000 Wang ..... F04B 25/02 137/538
6,027,319 A * 2/2000 Winefordner ..... F04B 33/005 417/440
6,120,265 A * 9/2000 Wu ..... F04B 33/005 417/526
6,135,733 A * 10/2000 Wu ..... F04B 33/005 417/469
6,190,142 B1 * 2/2001 Wu ..... F04B 33/005 417/523
6,257,849 B1 * 7/2001 Wu ..... F04B 33/005 417/469
6,270,327 B1 * 8/2001 Wolz ..... F04B 33/005 417/547
6,371,741 B1 * 4/2002 Wu ..... F04B 19/02 417/446
6,425,829 B1 * 7/2002 Julien ..... B21K 1/56 411/909
6,499,468 B1 * 12/2002 Ferraro ..... F02M 61/14 123/470
6,634,627 B1 * 10/2003 Stevenson ..... F16F 9/585 188/300
8,025,491 B2 * 9/2011 Wang ..... F04B 33/005 417/252
8,672,106 B2 * 3/2014 Laird ..... F16F 9/092 188/266.2
9,239,046 B2 * 1/2016 Wang ..... F04B 33/005
2001/0031211 A1 * 10/2001 Wu ..... F04B 33/005 417/469
2003/0156960 A1 * 8/2003 Wang ..... F04B 33/00 417/523
2003/0194329 A1 * 10/2003 Wu ..... F04B 33/005 417/63
2003/0194336 A1 * 10/2003 Wu ..... F04B 33/005 417/559
2004/0156726 A1 * 8/2004 Wu ..... F04B 33/005 417/469
2004/0253914 A1 * 12/2004 Becksvoort ..... B24B 33/08 451/478
2005/0098400 A1 * 5/2005 Kleinert ..... F16H 63/3433 188/300
2008/0223568 A1 * 9/2008 Roggeband ..... E21B 43/105 166/55
2008/0236967 A1 * 10/2008 Mayr ..... F16H 63/3433 188/300
2009/0175747 A1 * 7/2009 LeBoeuf ..... F04B 33/00 417/545
2009/0285697 A1 * 11/2009 Sorensen ..... F04B 5/02 417/523
2010/0104453 A1 * 4/2010 Wu ..... F04B 33/005 417/63
2011/0091339 A1 * 4/2011 Huang ..... F04B 33/005 417/437
2011/0280756 A1 * 11/2011 Huang ..... F04B 33/005 417/559
2012/0192993 A1 * 8/2012 Chuang ..... F04B 33/005 141/351
2012/0234401 A1 * 9/2012 Wu ..... F16L 37/00 137/231
2013/0087040 A1 * 4/2013 Schwiertz ..... F04B 53/22 92/169.1
2013/0101453 A1 * 4/2013 Chuang ..... F04B 33/005 417/521
2013/0136625 A1 * 5/2013 Chuang ..... F04B 33/005 417/234
2014/0180210 A1 * 6/2014 Niklaus ..... A61M 39/284 604/152
2016/0010637 A1 * 1/2016 Chuang ..... F04B 33/00 417/63
2016/0231185 A1 * 8/2016 Wu ..... G01L 17/00
2016/0312772 A1 * 10/2016 Chuang ..... F04B 33/005
2017/0167477 A1 * 6/2017 Hermansen ..... F04B 39/14
2018/0010592 A1 * 1/2018 Chuang ..... F04B 33/005
2018/0340524 A1 * 11/2018 Wang ..... F04B 33/00
2019/0203793 A1 * 7/2019 Deman ..... A47K 5/1205
2019/0309824 A1 * 10/2019 Jackson ..... B63B 21/502
2020/0056601 A1 * 2/2020 Wu ..... F04B 33/005
2020/0300232 A1 * 9/2020 Wang ..... F04B 29/00
2020/0300233 A1 * 9/2020 Wang ..... F04B 33/005

* cited by examiner

QUICKLY ASSEMBLED AIR PUMP COMPRISING A CYLINDER WITH A RETAINING HOLD ADJACENT TO AN OPENING FOR A POSITION ROD WHEREIN A RETAINING PORTION OF AN UPPER COVER IS ENGAGED WITH THE RETAINING HOLE AND A CONICAL LATERAL FACE OF A PISTON IS SELECTIVELY ABUTTED AGAINST AN EXTENSION PORTION OF THE UPPER COVER

BACKGROUND OF THE INVENTION

The present invention relates to a quickly assembled air pump.

Taiwan Patent No. TWI353417 discloses floor pump including a cylinder member, an outer cylinder, a valve stem set, and a hose. The cylinder member includes a body, a base and a cover. The body includes a first end and a second end threaded connected to the cover. With reference to FIGS. 2 and 3, an inner periphery of the cover and an outer edge of the second end of the body must be respectively provided with corresponding threads in order to assemble the cover to the second end of the body in a threaded manner.

However, assembling the cover to the body in a threaded manner causes the cover must be rotated during assembly, which increases the assembly time. In addition, the provision of threads on the body results in that a body wall of the body must be thick enough and not too thin. Generally, the thickness of the body wall needs to be more than 2 mm. Thus, the material cost is higher and cannot provide an aesthetic appearance.

In view of the above, a need exists for a novel air pump that mitigates and/or obviates the above drawbacks.

BRIEF SUMMARY OF THE INVENTION

An air pump according to the present invention includes a cylinder, a piston rod, and an upper cover. The cylinder forms an opening at a top end thereof and at least one retaining hole adjacent to the opening. The piston rod is configured to be movable within the cylinder and provided with a piston forming a conical lateral face at one end thereof. The upper cover has a top portion forming a hole for the piston rod to penetrate therethrough, at least one extension portion extended from the top portion, and at least one retaining portion extended from the extension portion. The least one extension portion has an abutting edge selectively abutted against the conical lateral face. The retaining portion is engaged with the retaining hole.

In an example, the at least one retaining hole penetrates through inner and outer walls of the cylinder.

In an example, the at least one retaining hole has a circular cross-sectional shape.

In an example, a wall thickness formed between the inner and outer walls of the cylinder is not greater than 2 mm.

In an example, the piston has an annular slot formed around an outer periphery thereof and extended along a circumferential direction thereof Δn air tight ring is disposed in the annular slot and abuts against the inner wall of the cylinder.

In an example, the at least one retaining portion is radially outward extended from the at least one extension portion and has an abutting face abutting against an inner edge of the at least one retaining hole, a bevel face, and a side face between the abutting face and the bevel face.

In an example, the abutting face and the side face are perpendicular to each other.

In an example, the upper cover further has an annular body portion separated from the at least one extension portion by a gap for the top end of the cylinder to penetrate therethrough.

In an example, the annular body portion has at least one buckle portion radially outward extended therefrom.

The present invention will become clearer in light of the following detailed description of illustrative embodiments of this invention described in connection with the drawings.

DETAILED DESCRIPTION OF THE INVENTION

Figure 1:
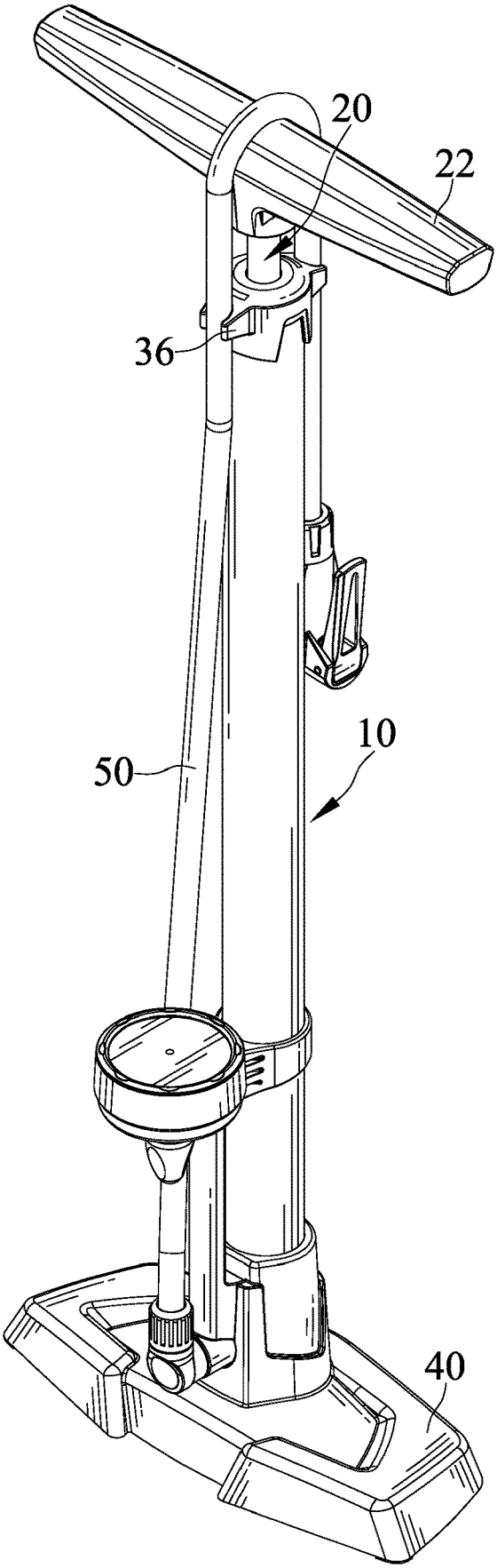
FIG. 1 is a perspective view of an air pump of an embodiment according to the present invention.
Figure 2:
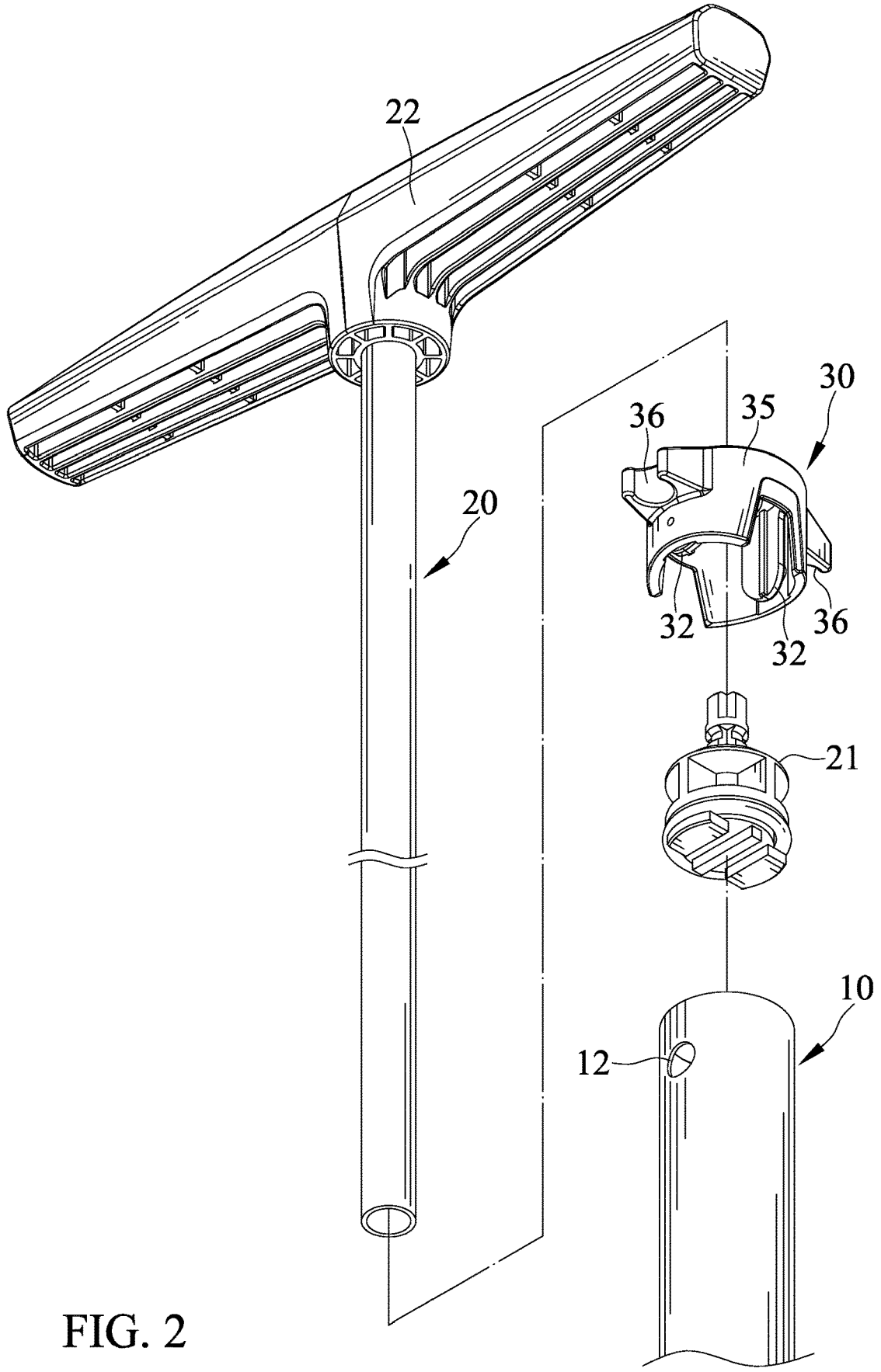
FIGS. 2 and 3 are exploded, perspective views of the air pump of FIG. 1.
Figure 3:
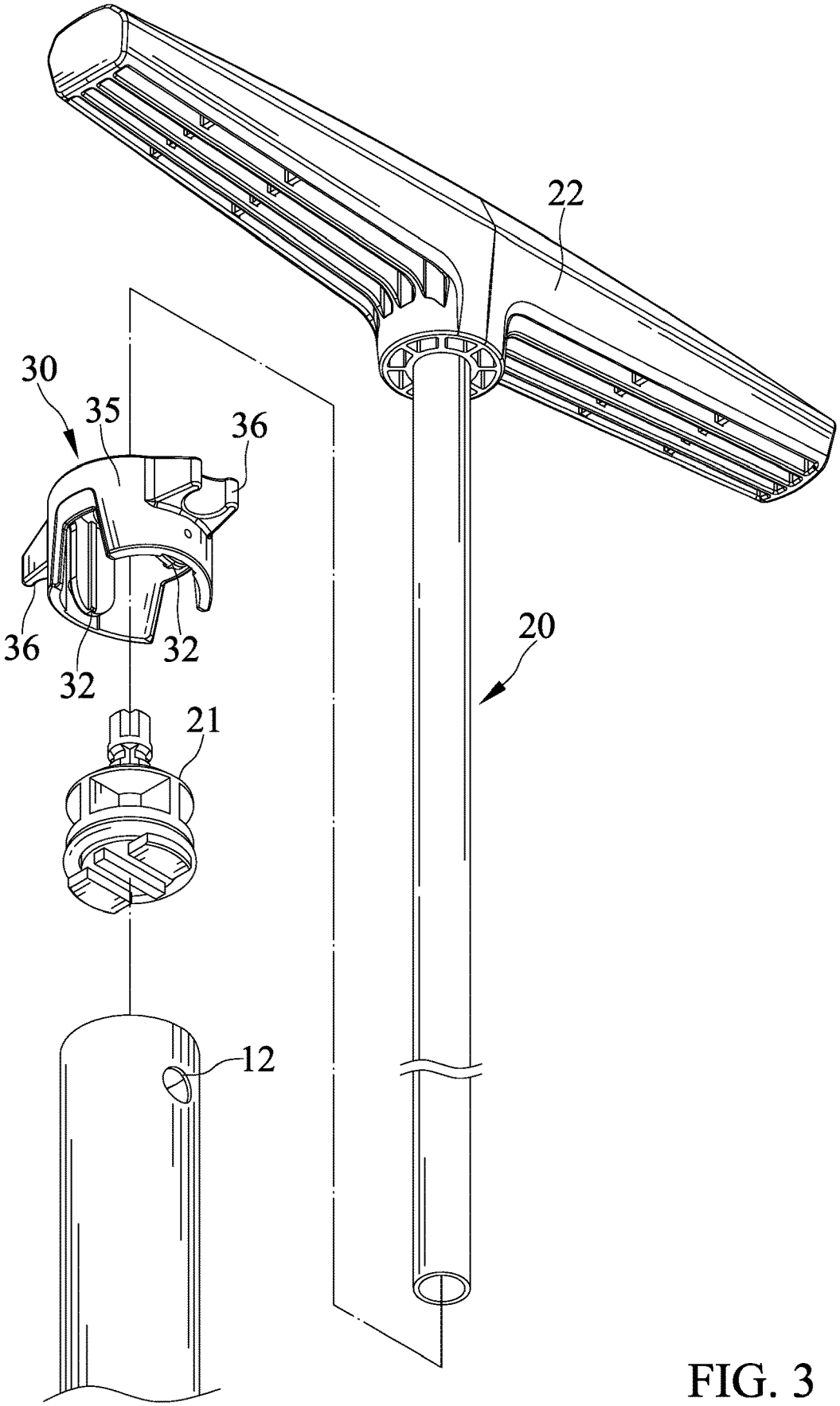
Figure 4:
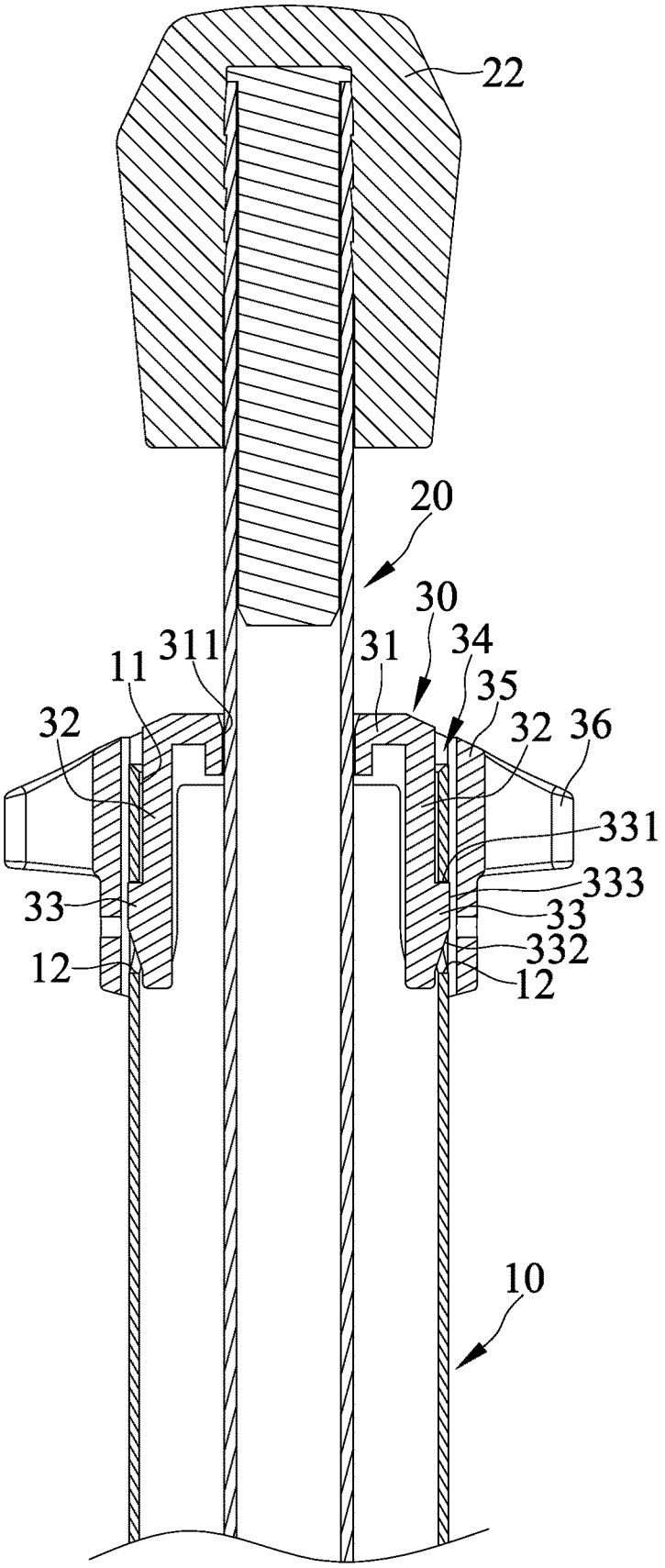
FIG. 4 is a partial, cross-sectioned view of the air pump of FIG. 1.

FIGS. 1-6 show an air pump of an embodiment according to the present invention. The air pump includes a cylinder 10, a piston rod 20, and an upper cover 30. The cylinder 10 forms an opening 11 at a top end thereof and at least one retaining hole 12 adjacent to the opening 11. In the embodiment, a bottom end of the cylinder 10 may be mounted on a base 40. The cylinder 10 unidirectionally communicates with a hose 50 so that air in the cylinder 10 compressed by the piston rod 20 can flow in an inflatable object (not shown) via the hose 50. The piston rod 20 is configured to be movable within the cylinder 10 and provided with a piston 21 disposed one terminal end thereof to compress air in the cylinder 10, and another end of the piston rod 20 has a handle 22 for the user. The upper cover 30 has a top portion 31 forming a hole 311 for the piston rod 20 to penetrate therethrough, at least one extension portion 32 extended from the top portion 31, and at least one retaining portion 33 extended from the extension portion 32. The retaining portion 33 is engaged with the retaining hole 12. Thus, the upper cover 30 does not need to be connected to the top end of the cylinder 10 in a threaded manner, which not only reduces the processing and assembling time, but also allows the cylinder 10 to have a thinner wall thickness, reduce material costs and have an aesthetic appearance.

In the embodiment, the number of the retaining hole 12, the extension portion 32, and the retaining portion 33 is two, correspondingly. Further, the retaining hole 12 penetrates through inner and outer walls of the cylinder 10 and has a circular cross-sectional shape. In addition, since the top end of the cylinder 10 does not need to be provided with threads, a wall thickness formed between the inner and outer walls of the cylinder 10 is not greater than 2 mm, and the wall thickness only needs to be about 1 mm.

The piston 21 forms a conical lateral face 211 at one end thereof, and one end of the extension portion 32 opposite to the top portion 31 has an abutting edge 321 selectively abutted against the conical lateral face 211. The piston 21 has an annular slot 212 formed around an outer periphery thereof and extended along a circumferential direction thereof, and an air tight ring 213 is disposed in the annular slot 212 and abuts against the inner wall of the cylinder 10 to prevent air in the cylinder 10 from escaping from the upper cover 30.

The retaining portion 33 is radially outward extended from the extension portion 32 and has an abutting face 331 abutting against an inner edge of the retaining hole 12, a bevel face 332, and a side face 333 between the abutting face 331 and the bevel face 332. The abutting face 331 and the side face 333 are perpendicular to each other. The upper cover 30 further has an annular body portion 35 separated from the extension portion 32 by a gap 34 for the top end of the cylinder 10 to penetrate therethrough. Furthermore, the annular body portion 35 has at least one buckle portion 36 radially outward extended therefrom. The number of the buckle portions 36 in the embodiment can be two and can be used to buckle the hose 50. Thus, when the assembler only need to press the upper cover 30 to the top end of the cylinder 10 to complete assembly. The bevel face 332 makes the retaining portion 33 easier to pass the opening 11, and the extension portion 32 is slightly opposite to the top portion 31 shrinks inward so that the retaining portion 33 enters the cylinder 10 via the opening 11 until the retaining portion 33 is engaged into the retaining hole 12 to quickly assemble the upper cover 30 to the top end of the cylinder 10.

Figure 5:
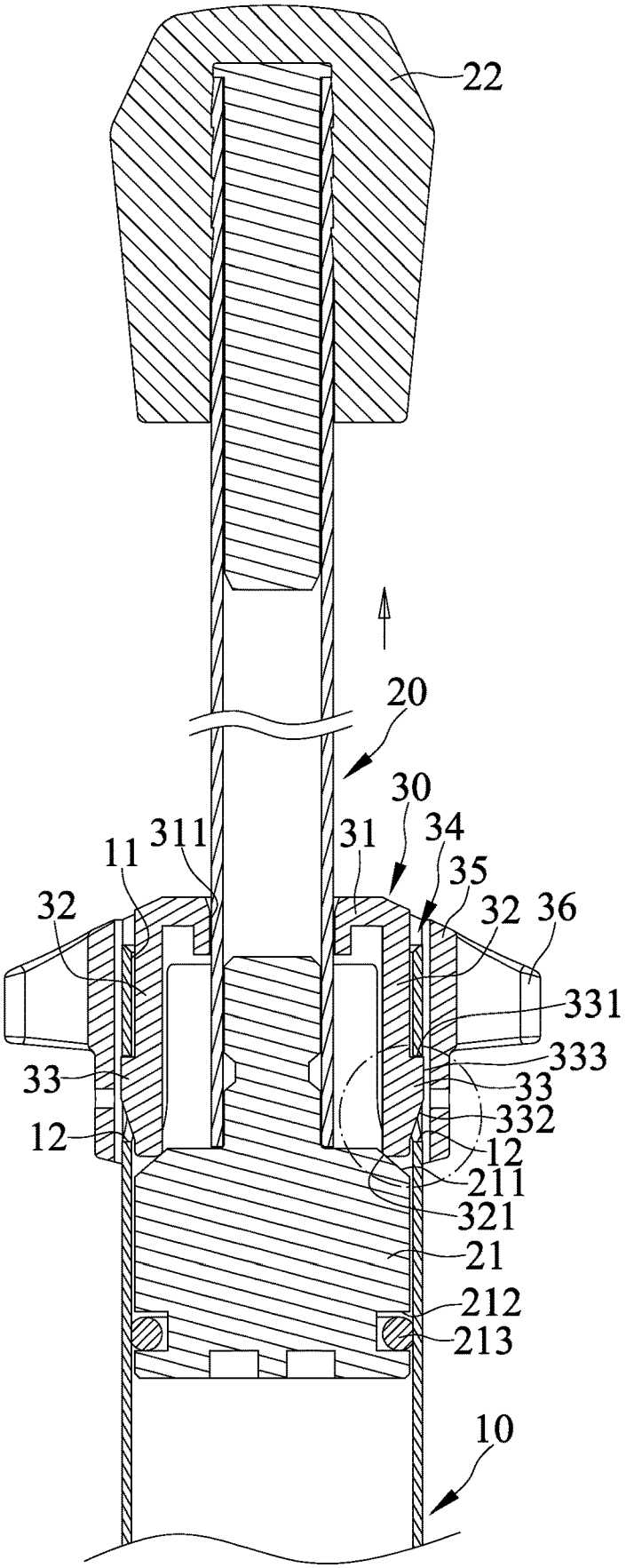
FIG. 5 is a continued view of view of FIG. 4 and illustrates a piston abutting an upper cover.
Figure 6:
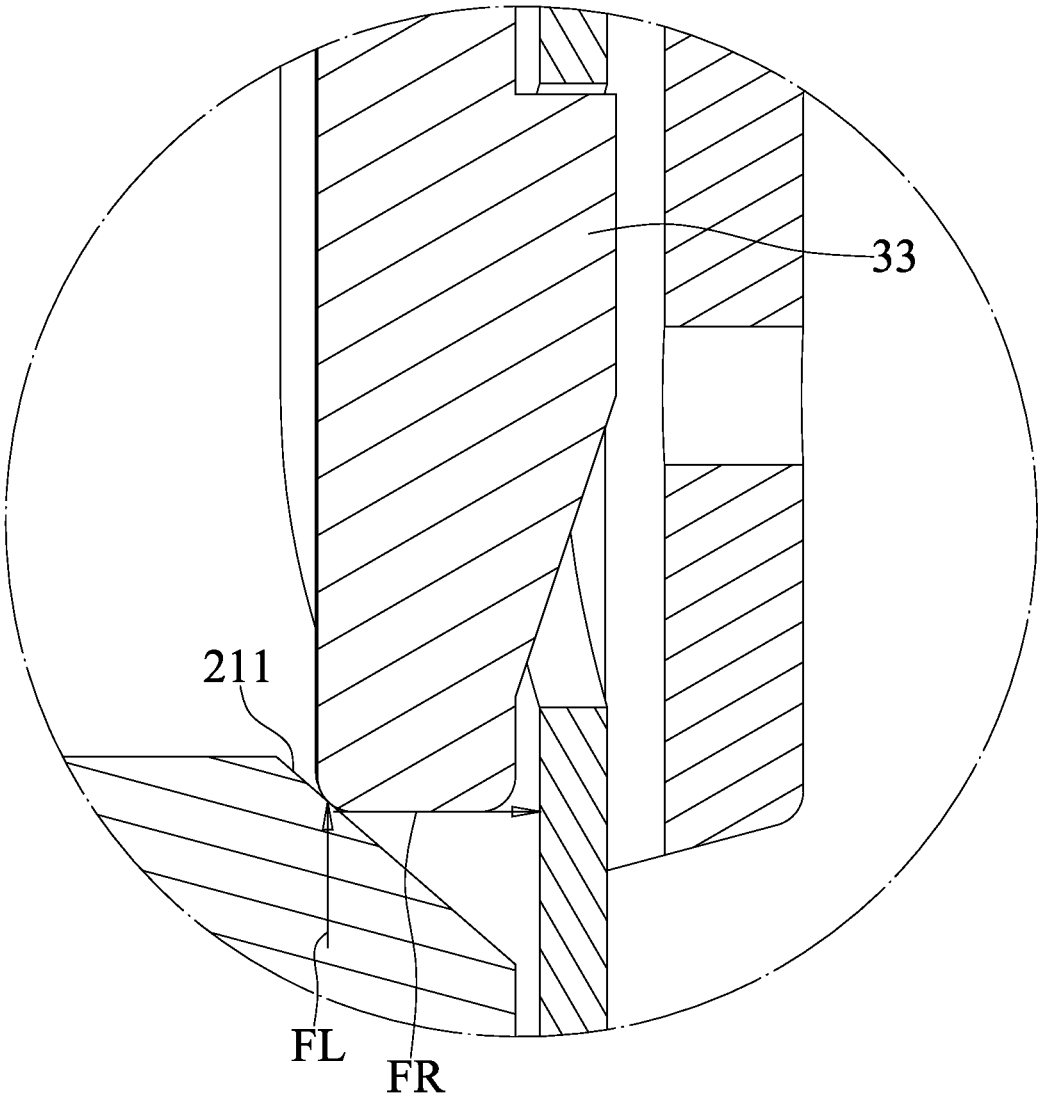
FIG. 6 is an enlarged view of circled area a of FIG. 5.

With reference FIGS. 5 and 6, when the user holds the handle 22 and applies force to make the piston rod 20 reciprocate relative to the cylinder 10, once the piston 21 reaches the top dead center, the conical lateral face 211 of the piston 21 pushes against the abutting edge 321 of the extension portion 32 and cannot move upward relative to the cylinder 10 no more. Thus, the conical lateral face 211 of the piston 21 pushes against and the transmits an action force to the abutting edge 321 of the extension portion 32. A longitudinal force FL of the action force causes the abutting face 331 of the retaining portion 33 to abut against the inner edge of the retaining hole 12, and a radial force FR of the action force causes the side face 333 of the retaining portion 33 to move slightly radially outward through the retaining hole 12, so that the retaining strength between the retaining portion 33 and the retaining hole 12 will increase as the abutting edge 321 of the extension portion 32 of the upper cover 30 is pushed against by the conical lateral face 211 of the piston 21.

Although specific embodiments have been illustrated and described, numerous modifications and variations are still possible without departing from the scope of the invention. The scope of the invention is limited by the accompanying claims.

The invention claimed is:

1. An air pump comprising:

a cylinder forming an opening at a top end thereof and at least one retaining hole adjacent to the opening;

a piston rod configured to be movable within the cylinder and provided with a piston forming a conical lateral face at one end thereof; and an upper cover having a top portion forming a hole for the piston rod to penetrate therethrough, at least one extension portion extended from the top portion, and at least one retaining portion extended from the at least one extension portion, wherein one end of the at least one extension portion opposite to the top portion has an abutting edge selectively abutted against the conical lateral face, and wherein the at least one retaining portion is engaged with the at least one retaining hole.

2. The air pump as claimed in claim 1, wherein the at least one retaining hole penetrates through inner and outer walls of the cylinder.

3. The air pump as claimed in claim 2, wherein the at least one retaining hole has a circular cross-sectional shape.

4. The air pump as claimed in claim 2, wherein a wall thickness formed between the inner and outer walls of the cylinder is not greater than 2 mm.

5. The air pump as claimed in claim 1, wherein the piston has an annular slot formed around an outer periphery thereof and extended along a circumferential direction thereof, and wherein an air tight ring is disposed in the annular slot and abuts against the inner wall of the cylinder.

6. The air pump as claimed in claim 1, wherein the at least one retaining portion is extended radially outward from the at least one extension portion and has an abutting face abutting against an inner edge of the at least one retaining hole, a bevel face, and a side face between the abutting face and the bevel face.

7. The air pump as claimed in claim 6, wherein the abutting face and the side face are perpendicular to each other.

8. The air pump as claimed in claim 6, wherein the upper cover further has an annular body portion separated from the at least one extension portion by a gap for the top end of the cylinder to penetrate therethrough.

9. The air pump as claimed in claim 8, wherein the annular body portion has at least one buckle portion radially outward extended therefrom.

* * * * *